US005482654A

United States Patent [19]

Luttrell et al.

[11] Patent Number: 5,482,654

[45] Date of Patent: Jan. 9, 1996

[54] SAFETY INDICATOR SYSTEM

[75] Inventors: Mark G. Luttrell, Memphis, Tenn.; Lyle D. Wescott, Jr., Holly Springs, Miss.

[73] Assignee: Warnaway Corporation, Memphis, Tenn.

[21] Appl. No.: 336,472

[22] Filed: Nov. 9, 1994

[51] Int. Cl.[6] ..... B05D 5/06

[52] U.S. Cl. ..... 252/408.1; 252/106; 424/10.3

[58] Field of Search ..... 252/106, 408.1; 424/7.1

[56] References Cited

U.S. PATENT DOCUMENTS

| | | | |
|---|---|---|---|
| 3,355,392 | 11/1967 | Cantor et al. | 252/99 |
| 3,467,610 | 9/1969 | Fiarman et al. | 260/22 |
| 3,650,831 | 3/1972 | Jungermann et al. | 134/27 |
| 3,808,036 | 4/1974 | Zdanowski | 117/138.8 |
| 3,933,511 | 1/1976 | Heintzelman et al. | 106/10 |
| 4,070,510 | 1/1978 | Kahn | 427/385 |
| 4,071,645 | 1/1978 | Kahn | 427/340 |
| 4,420,412 | 12/1983 | Wong | 252/186.38 |
| 4,499,001 | 2/1985 | Eoga | 252/99 |
| 4,678,658 | 7/1987 | Casey et al. | 424/7.1 |
| 4,793,988 | 12/1988 | Casey et al. | 424/7.1 |
| 4,965,063 | 10/1990 | Casey et al. | 424/7.1 |
| 5,057,303 | 10/1991 | Casey | 424/7.1 |
| 5,064,635 | 11/1991 | Casey | 424/7.1 |
| 5,110,492 | 5/1992 | Casey | 252/90 |

FOREIGN PATENT DOCUMENTS 2198991 4/1974 France .

*Primary Examiner*—Paul Lieberman
*Assistant Examiner*—Wyatt B. Pratt
*Attorney, Agent, or Firm*—Luedeka, Neely, Graham & Neely

[57] ABSTRACT

A method for use in warning about wet flooring conditions is disclosed. The method comprises the use of an indicator composition containing from about 90 to about 50 wt. % of basic compound; and from about 10 to about 50 wt. % of a compound selected from the group consisting of a phthalic anhydride derivative of the formula

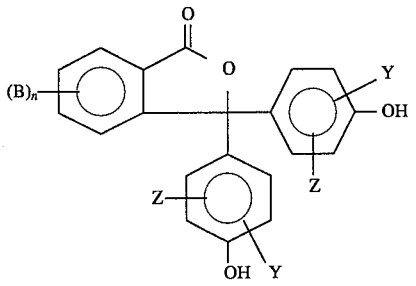

and a poly-nitrophenolic compound of the formula

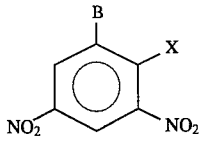

wherein n is an integer selected from 0 to 4, each Y and each Z is selected from an alkyl group having 1 to 6 carbon atoms and hydrogen, B is selected from hydrogen and —$NO_2$, and X is selected from

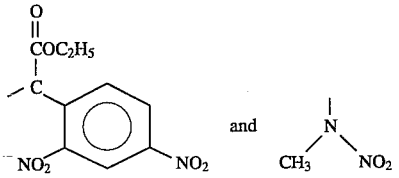

whereby an intensely colored solution is formed when the composition is in the presence of an amphoprotic liquid.

12 Claims, No Drawings

SAFETY INDICATOR SYSTEM

FIELD OF THE INVENTION

This invention relates to compositions and methods useful for effectively warning of wet flooring conditions thereby reducing the frequency of slip and fall accidents.

BACKGROUND

In many industrial and commercial establishments, such as stores, hospitals, restaurants, nursing homes, schools and the like, tile, vinyl or concrete flooring is used because of its durability and the ease for which it can be cleaned. However, during the cleaning process, the flooring may remain wet for an extended period of time. If the flooring is relatively smooth, even a small amount of liquid on the flooring may make the flooring slick. One of the most frequent accidents is the slip and fall accident generally due to these wet and slick flooring conditions.

In order to signify that the flooring is wet and that a slipping hazard exists, safety barriers or safety signs are frequently erected. However, these safety barriers and signs are easily circumvented, and often times are circumvented by the public. Furthermore, the safety barriers and signs merely indicate that a hazard may exist, not that there is actually a hazard present. Consequently, once the flooring is dry, the barriers tend to remain in place for a period of time thus losing their credibility and effectiveness. There is presently no automatic mechanism for signifying when the flooring is dry and safe for use. As a result, many people simply ignore the safety barriers and warning signs and walk on the wet flooring.

As the cost to businesses for damage claims for slip and fall accidents increases and as medical costs escalate, businesses are constantly looking for improved ways to warn the public about the existence of wet flooring conditions. There is a need therefore for a warning system which can indicate the existence of wet flooring conditions and which will automatically signify when the wet flooring conditions and the slipping hazards are no longer present.

An object of this invention therefore is to provide a composition which can be used to readily warn the public about the existence of wet or damp flooring conditions.

Another object of this invention is to provide a method for indicating the presence of wet flooring conditions.

Still another object of this invention is to provide a composition and method comprising an indicator compound and a basic compound which can be used to signify the presence of moisture or liquid on flooring.

In yet another object of this invention, there is provided a composition containing an indicator compound and a strong base which composition remains highly colored on flooring in the presence of certain liquids and which turns essentially colorless when the flooring is substantially dry.

These and other objects of the invention will now be described in more detail.

THE INVENTION

In one embodiment this invention provides a safety indicator composition for use in warning about wet flooring conditions. The composition consists essentially of (i) from about 10 to about 50 wt. % of a pH indicator compound; and (ii) from about 50 to about 90 wt. % of a basic compound.

In another embodiment, the invention provides a safety warning system for use in warning about wet flooring conditions. The system comprises an indicator composition containing from about 50 to about 90 wt. % of basic compound and from about 10 to about 50 wt. % of a compound selected from the group consisting of a phthalic anhydride derivative of the formula

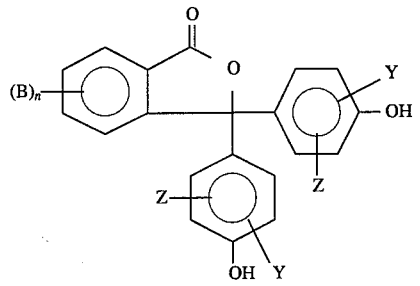

and a poly-nitrophenolic compound of the formula

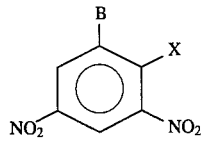

wherein n is an integer selected from 0 to 4, each Y and each Z is selected from an alkyl group having 1 to 6 carbon atoms and hydrogen, B is selected from hydrogen and —$NO_2$, and X is selected from

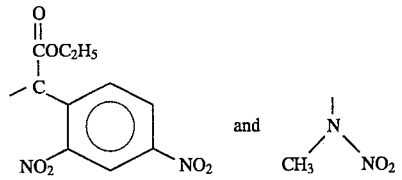

whereby an intensely colored solution is formed when the composition is in the presence of an amphoprotic liquid.

In yet another embodiment, this invention provides a method for warning about the presence of wet flooring conditions. The method comprises forming a safety indicator composition containing (i) from about 10 to about 50 wt. % of an indicator compound selected from the group consisting of a phthalic anhydride derivative of the formula

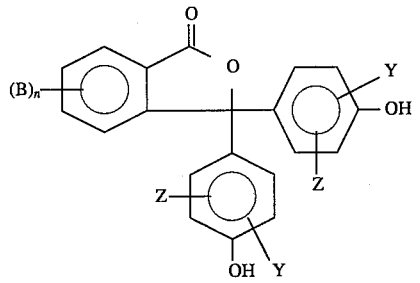

and a poly-nitrophenolic compound of the formula

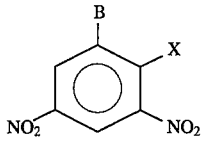

wherein n is an integer selected from 0 to 4, each Y and each Z is selected from an alkyl group having 1 to 6 carbon atoms and hydrogen, B is selected from hydrogen and —$NO_2$, and X is selected from

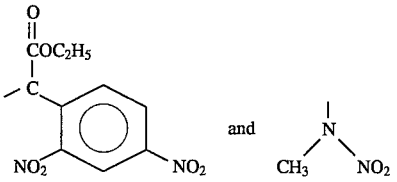

and (ii) from about 50 to about 90 wt. % of basic compound which basic compound is sufficient to provide an intensely colored solution when the composition is in the presence of an amphoprotic liquid. The safety indicator composition of this invention may be admixed with any cleaning solution containing at least one amphoprotic component and/or a detergent so that a highly colored cleaning solution is formed. This highly colored cleaning solution may then be used to clean the flooring whereby the flooring thus cleaned remains highly colored in the presence of an amphoprotic liquid and the flooring reverts to its original color when substantially all of the amphoprotic liquid has evaporated.

The indicator compounds useful with this invention are compounds which are highly colored under basic conditions when in the presence of amphoprotic liquids and which are essentially colorless in the absence of such amphoprotic liquids. Indicator compounds which may be used include m-nitrophenol, p-nitrophenol, dinitrobenzoylene urea, ethylbis(2,4-dinitrophenyl)acetate, cyanine, 2,4,6-trinitrophenylmethylnitramine, o-cresolphthalein, thymolphthalein, and phenolphthalein. The most preferred compounds which have been found to be particularly useful are the phthalic anhydride derivatives containing substituted or unsubstituted phenolic groups. The compounds have the general formula of

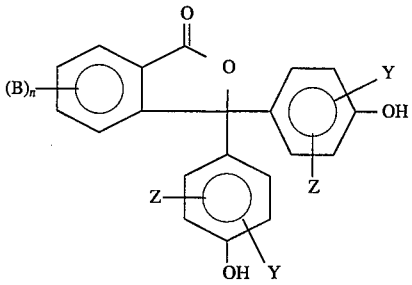

wherein n is an integer selected from 0 to 4, each Y and each Z is selected from an alkyl group having 1 to 6 carbon atoms and hydrogen and B is selected from hydrogen and —$NO_2$. In one particularly preferred phthalic anhydride derivative compound, Y is a —$CH_3$ group, Z and B are hydrogen and n is 4. In another particularly preferred phthalic anhydride derivative compound, Y is a —$CH(CH_3)_2$ group, Z is a —$CH_3$ group, B is hydrogen and n is 4. In still another particularly preferred phthalic anhydride derivative compound, Y, Z and B are hydrogen and n is 4.

Other compounds used as pH indicators may also be used provided they are highly colored in the presence of a basic compound and an amphoprotic liquid and are essentially colorless in the substantial absence of such amphoprotic liquids and leave little or no residue on the flooring, once the flooring is substantially dry.

A key feature of this invention is the formation of an essentially dry mixture of indicator compound and strong, basic compound so that when the mixture is admixed with a cleaning solution, the flooring cleaned with the cleaning solution containing the mixture remains highly colored in the presence of an amphoprotic liquid and reverts to its original color when substantially all of the amphoprotic liquid has evaporated. If the color fades before all of the liquid from the cleaning solution evaporates, there will be a loss of indication that the flooring is still wet. Hence it is critical that a sufficient amount of basic compound be used with the indicator compound whereby the flooring remains highly colored when even a minor amount of liquid is present. Furthermore, the amount of basic compound used should be an amount such that the flooring returns to its original color when it is substantially dry. It will be recognized that even a small amount of liquid on some very smooth flooring can create slick conditions and thus provide a slipping hazard. Hence, the term "substantially dry" means that less than an amount of liquid generally required to form a slipping hazard remains on the flooring. The amount of liquid capable of forming a slipping hazard may vary with the type of flooring and the smoothness of the flooring. But in all cases, some readily determinable, finite amount of liquid is generally needed to form a slipping hazard.

The particular indicator compound useful with the methods and compositions of this invention are selected so that they sufficiently contrast with the original flooring color. Accordingly, a blue indicator compound may be used with any flooring which is not blue or which is of a color that does not contrast adequately with blue. Likewise, a red indicator compound may be used with any flooring which is not red or which is of a color that does not contrast adequately with red.

Suitable basic compounds useful with the compositions and methods of this invention include the alkali or alkaline earth metal hydroxides, oxides and phosphates such as trisodium phosphate, calcium hydroxide, lithium hydroxide, magnesium hydroxide, potassium hydroxide, sodium hydroxide, calcium oxide, lithium oxide, magnesium oxide, sodium oxide, and the like, or mixtures of two or more of the foregoing. Other strong basic compounds may be used provided they will react with air to form less basic, neutral or acidic compounds. The most preferred basic compounds are selected from sodium hydroxide, lithium hydroxide, and trisodium phosphate.

The amount of basic compound used in the compositions of this invention may range from 1 to 100 moles of basic compound, per mole of indicator compound. The more preferred ratio of basic compound to indicator compound is 10 moles to 60 moles, and most preferably 20 moles to about 50 moles. For strongly basic aqueous cleaning solutions, less basic compound may be used. For weaker basic cleaning solutions, more basic compound is typically used. Those skilled in the art can readily determine suitable amounts of basic compound to provide compositions which remain highly colored in the presence of amphoprotic liquids and turn essentially colorless in the absence of such amphoprotic liquids.

While not being bound by theory it is believed that a strong basic compound in the compositions and methods of this invention will combine with carbon dioxide in the air when the flooring is substantially dry thereby neutralizing the effect of the strong base and forming a more neutral or acidic composition. If too little basic compound is present, the neutral or acidic condition will occur much sooner thereby causing the liquid to turn colorless before the flooring is dry. Hence there is a critical amount of basic compound needed to effect and maintain the desired highly colored condition for as long as any amphoprotic liquid remains on the flooring.

To form the indicator compositions of this invention for use with cleaning solutions, the components of the indicator system are typically combined as substantially dry components. This dry mixture can be stored for extended periods of time without losing its activity. Furthermore, a premeasured amount of indicator composition containing at least one indicator compound and at least one basic compound can be formed which can be added to the cleaning solution when the cleaning solution is ready to use.

The cleaning solutions with which the indicator compositions of this invention may be used include any of the cleaning solutions typically used for cleaning industrial, commercial and residential flooring. The only limitation on the cleaning solution is that it have an amphoprotic characteristic or a liquid amphoprotic component. While the indicator compounds of this invention can be adapted to be used with organic cleaning solutions, it is typically preferred to utilize aqueous cleaning solutions.

Cleaning solutions which can be used with the safety warning system of this invention include solutions of light duty type cleaners utilizing only a surfactant or detergent system or they can be solutions of heavy duty cleaners or solvents. The surfactant is typically diluted with water to give the desired cleaning strength. The surfactant can be anionic, nonionic, amphoteric or a mixture of all three.

Typical anionic surfactants used in cleaners are petroleum sulfonates, such as sodium dodecylbenzene sulfonate, alcohol sulfates such as sodium lauryl sulfate and ethoxylated higher fatty alcohol sulfates such as sodium lauryl ether sulfate. Typical nonionic surfactants are primary alcohol ethoxylates, secondary alcohol ethoxylates, alkyl phenol ethoxylates and alkanolamides. The amphoteric surfactants include a number of types of carboxylates derived from fatty imidazolines such as sodium dicarboxyethylcoco phosphoethyl imidazoline or fatty proprionates such as cocoamphoproprionate or cocoamphodiproprionate.

In order to use the safety warning system of this invention the indicator composition is generally admixed with the cleaning solution prior to cleaning the floor. The method for forming the admixture of indicator composition and cleaning solutions is not critical to the invention. The amount of indicator composition added to the cleaning solutions can range from about 0.1 wt. % to about 20 wt. %, preferably from about 0.3 wt. % to about 15 wt. %, and most preferably from about 0.45 wt. % to about 10 wt. %.

Once formed the cleaning solution containing indicator composition can be applied to any durable flooring such as concrete, tile, vinyl, wood and the like. In the presence of an amphoprotic liquid such as water, the indicator system remains highly colored. Once all of the liquid has substantially evaporated, the flooring reverts to its original color.

A feature of this invention is that the indicator compound leaves essentially no noticeable residue. Furthermore, upon re-wetting the flooring treated with the cleaning solution containing the indicator composition of this invention, a highly colored condition may reappear thereby again indicating the presence of liquid on the flooring.

In order to further illustrate the invention the following examples are given.

EXAMPLE 1

Trisodium phosphate (20.0 grams, 0.122 mols) is admixed with 5 grams (0.0144 mols) of ortho-cresolphthalein as a dry mixture. This dry mixture is then added to one gallon of water containing a detergent. The aqueous cleaning solution containing the indicator composition is then used to mop flooring. The red color of the warning system persists as long as there is any moisture present.

EXAMPLE 2

Lithium hydroxide (12.0 grams, 0.5 mols) is admixed with 5 grams (0.0116 mols) of thymolphthalein as a dry mixture. This dry mixture is then added to one gallon of water containing a detergent. The aqueous cleaner containing the indicator composition is then used to mop flooring. The blue color of the warning system persists as long as there is any moisture present.

EXAMPLE 3

Trisodium Phosphate (20.0 grams, 0.122 mols) is admixed with 6 grams (0.0188 mols) of phenolphthalein as a dry mixture. This dry mixture is then added to one gallon of water, containing a detergent. The aqueous cleaner containing the indicator composition is then used to mop flooring. The red color of the warning system persists as long as there is any moisture present.

EXAMPLE 4

Sodium hydroxide (12.0 grams, 0.3 mols) is admixed with 5 grams (0.0144 mols) of ortho-cresolphthalein as a dry mixture. This dry mixture is then added to one gallon of water containing a detergent. The aqueous cleaner containing the indicator composition is then used to mop flooring. The red color of the warning system persists as long as there is any moisture present.

While the foregoing description and examples are generally directed to compositions and methods for signifying wet flooring conditions, the compositions and methods of this invention can readily be adapted for use on any surface where it is desirable to indicate the presence of liquids. Hence, the foregoing methods and compositions can be used for cleaning counter tops, appliances, shower stalls, bathtubs, and the like.

Having described and illustrated the invention in its preferred embodiments, it will be recognized that the invention is not limited thereby and is subject to variations within the spirit and scope of the appended claims.

What is claimed is:

1. A system for use in warning about wet flooring conditions, the system being added to a cleaning composition and containing sufficient basic compound such that when added to the cleaning composition the cleaning composition is highly colored and reverts to its colorless state when the liquid has evaporated, the system comprising and essentially dry indicator composition containing:

from about 50 to about 90 wt. % of basic compound selected from the group consisting of alkali and alkaline earth metal hydroxides, alkali and alkaline earth metal oxides and alkali and alkaline earth metal phosphates; and from about 10 to about 50 wt % of a compound selected from the group consisting of a phthalic anhydride derivative of the formula

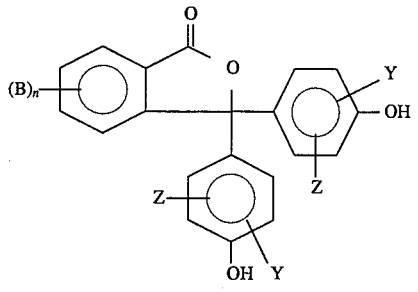

and a poly-nitrophenolic compound of the formula

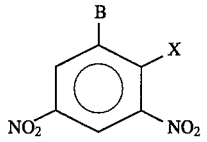

wherein n is an integer selected from 0 to 4, each Y and each Z is selected from an alkyl group having 1 to 6 carbon atoms and hydrogen, B is selected from hydrogen and —$NO_2$, and X is selected from

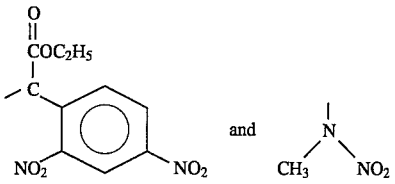

whereby an intensely colored solution is formed when the indicator composition is in the presence of an amphoprotic liquid.

2. The safety warning system of claim 1 wherein Z is an alkyl group of the formula —$CH(CH_3)_2$.

3. The safety warning system of claim 2 wherein Y is an alkyl group of the formula —$CH_3$.

4. The safety warning system of claim 1 wherein Y, Z, and B are hydrogen atoms and n is 4.

5. The safety warning system of claim 1 wherein Y is an alkyl group of the formula —$CH_3$, Z and B are hydrogen atoms and n is 4.

6. The safety warning system of claim 1 wherein the basic compound is selected from sodium hydroxide, lithium hydroxide and trisodium phosphate.

7. A method for warning about the presence of wet flooring conditions comprising:

preparing an essentially dry safety indicator composition containing (i) from about 10 to about 50 wt. % of an indicator compound selected from the group consisting of a phthalic anhydride derivative of the formula

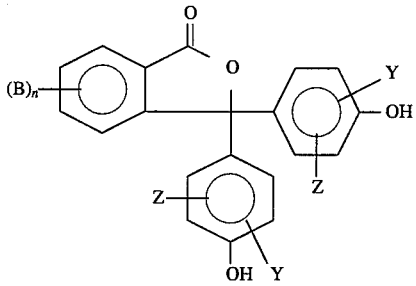

and a poly-nitrophenolic compound of the formula

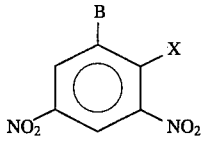

wherein n is an integer selected from 0 to 4, each Y and each Z is selected from an alkyl group having 1 to 6 carbon atoms and hydrogen, B is selected from hydrogen and —$NO_2$, and X is selected from

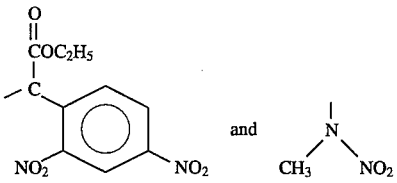

and (ii) from about 50 to about 90 wt. % of basic compound selected from the group consisting of alkali and alkaline earth metal hydroxides, alkali and alkaline earth metal oxides and alkali and alkaline earth metal phosphates;

admixing said safety indicator composition with a liquid cleaning composition containing a detergent to form a highly colored cleaning solution; and cleaning the flooring with said colored cleaning solution whereby the flooring remains highly colored in the presence of the liquid cleaning solution and reverts to its colorless state when the liquid has evaporated.

8. The method of claim 7 wherein Z is an alkyl group of the formula —$CH(CH_3)_2$.

9. The method of claim 8 wherein Y is an alkyl group of the formula —$CH_3$.

10. The method of claim 7 wherein Y, Z and B are hydrogen atoms and n is 4.

11. The method of claim 7 wherein Y is an alkyl group of the formula —$CH_3$, Z and B are hydrogen atoms and n is 4.

12. The method of claim 7 wherein the basic compound is selected from sodium hydroxide, lithium hydroxide and trisodium phosphate.

* * * * *